US007082628B1

(12) United States Patent
Bellecci et al.

(10) Patent No.: US 7,082,628 B1
(45) Date of Patent: Aug. 1, 2006

(54) DISPOSABLE SOLID WASTE DETAINMENT PLUMBING TRAP

(76) Inventors: John Bellecci, 11058 Major Oak Dr., Baton Rouge, LA (US) 70815; John F. Gleason, P.O. Box 1745, Denham Springs, LA (US) 70727-1745

( * ) Notice: Subject to any disclaimer, the term of this patent is extended or adjusted under 35 U.S.C. 154(b) by 340 days.

(21) Appl. No.: 10/708,959

(22) Filed: Apr. 2, 2004

Related U.S. Application Data

(60) Provisional application No. 60/460,790, filed on Apr. 7, 2003.

(51) Int. Cl.
*E03C 1/12* (2006.01)
*F16K 13/00* (2006.01)

(52) U.S. Cl. ..... 4/679; 4/681; 137/247.45; 137/247.51; 137/546; 210/515

(58) Field of Classification Search ..... 4/679–681, 4/DIG. 14; 137/247.45, 247.49, 247.51, 137/546; 210/515
See application file for complete search history.

(56) References Cited

U.S. PATENT DOCUMENTS 5,075,905 A * 12/1991 Rutherford ..... 4/679
5,797,742 A * 8/1998 Fraker ..... 210/515
6,049,922 A 4/2000 Gleason ..... 4/681

* cited by examiner

*Primary Examiner*—Tuan Nguyen
(74) *Attorney, Agent, or Firm*—Reginald F. Roberts, Jr.

(57) ABSTRACT

A disposable solid waste detainment plumbing trap. The trap has a container for collecting water and solid waste discharged from a sink through a line threadably connected to an inlet of the container, and for discharging water through an outlet threadably connected to a waste line. It has a lid which seals the container, and a valve for venting either air or water from the container, to relieve the pressure of air trapped in the container. Using this disposable trap, solid waste from a sink can be quickly and easily collected and disposed of without spilling of or contact with water or the solid waste.

6 Claims, 7 Drawing Sheets

DISPOSABLE SOLID WASTE DETAINMENT PLUMBING TRAP

CROSS REFERENCE TO RELATED APPLICATIONS

This application is a non-provisional application based on provisional application 60/460,790, filed Apr. 7, 2003.

BACKGROUND OF INVENTION

The present invention relates to plumbing. More particularly, the invention relates to a plumbing trap for the collection and disposal of solid waste.

SUMMARY OF INVENTION

In general, the present invention in a first aspect provides a disposable solid waste detainment plumbing trap. The trap comprises (a) a container for collecting water and solid waste discharged from a sink through an inlet of the container, and for discharging water through a first outlet of the container, the inlet being constructed and arranged for direct connection to a first line connected to the sink, and the first outlet being constructed and arranged for direct connection to a second line for waste disposal; (b) a lid that seals the container; and (c) a valve for venting air or water from the container, to relieve the pressure of air trapped in the container. The inlet and the first outlet of the container are disposed in and through the lid, and extend into the container to a distance below the lid. The valve is connected to a second outlet that extends into the container to a shorter distance below the lid than the first outlet, whereby the level of the water can be adjusted so that an end of the second outlet is either above or below the surface of the water. The pressure of the trapped air is relieved by opening the valve to discharge air or water from the container.

In a second aspect, the invention provides a method for disposing of solid waste discharged from a plumbing sink. The method comprises the following steps: (a) providing a container for collecting water and solid waste discharged from the sink through an inlet of the container, and for discharging water through a first outlet of the container, the inlet being constructed and arranged for direct connection to a first line connected to the sink, and the first outlet being constructed and arranged for direct connection to a second line for waste disposal; (b) providing a lid for sealing the container, the inlet and the first outlet being disposed in and through the lid, and extending into the container to a distance below the lid; (c) providing a valve for venting air or water from the container, to relieve the pressure of air trapped in the container, the valve being connected to a second outlet extending into the container to a shorter distance below the lid than the first outlet, whereby the level of the water can be adjusted so that an end of the second outlet is either above or below the surface of the water, and the pressure of the air trapped in the container can be relieved by opening the valve to discharge air or water from the container; (d) connecting the inlet to the first line, and the first outlet to the second line; (e) discharging water and solid waste into the container through the first line and the inlet of the container; (f) adjusting the level of the water in the container; and (g) opening the valve to discharge air or water from the container.

DETAILED DESCRIPTION

Figure 1:
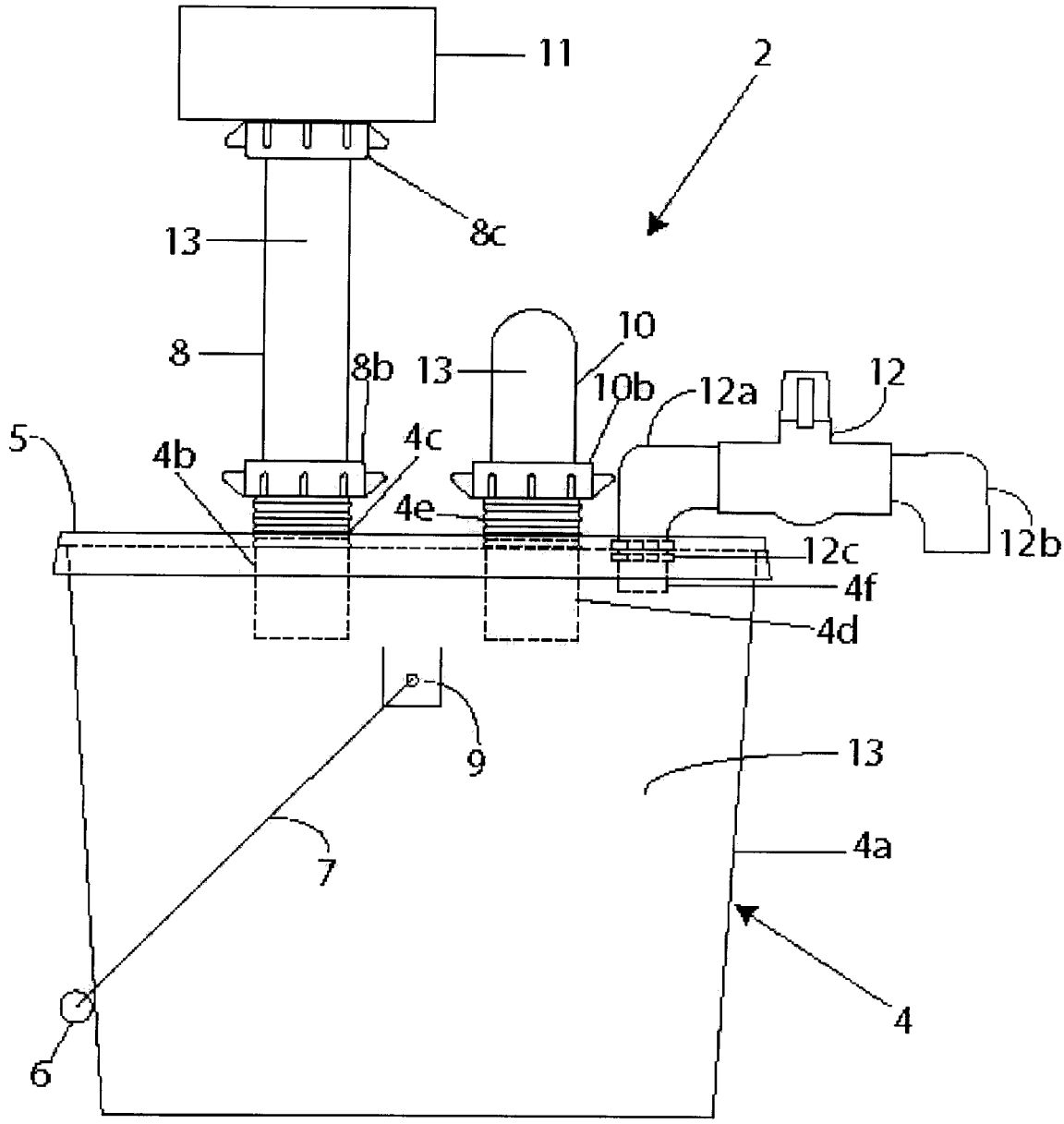
FIG. 1 is a schematic representation of a disposable solid waste detainment trap, made in accordance with the principles of the present invention, showing a drain valve closed, and the trap connected to a sink and to waste disposal.

More specifically, reference is made to FIG. 1, in which is shown a system for the collection and disposal of solid waste, the system being generally designated by the numeral 2. The system 2 comprises a disposable solid waste detainment trap 4 having a transparent or translucent container 4*a* with an inlet 4*b*, a first outlet 4*d*, and a drain valve 12. The trap 4 includes a handle 6 connected to the container 4*a* by a wire or cord 7 attached by a fastener 9 to the container 4*a*. The lid 5 is pressure-fitted to the container 4*a*, for easy attachment to and detachment from the container 4*a*. The inlet 4*b* and the first outlet 4*d* are inserted in the lid 5 through openings therein (not shown). The drain valve 12 is connected through the lid 5 and an opening therein (not shown) to the interior of the container 4*a* by a first connecting member 12*a* coupled by connectors 12*c* to a second outlet 4*f*, and to the exterior of the container 4*a* by a second connecting member 12*b*. The inlet 4*b* is thread 4*c* connected to a line 8 from a sink 11, using solid schedule 40 plumbing. The first outlet 4*d* is thread 4*e* connected to a waste line 10, using solid schedule 40 plumbing. The inlet 4*b* is secured to the lid 5 by a first nut 8*b*. The sink line 8 is secured to the sink 11 by a second nut 8*c*. The first outlet 4*d* is secured to the lid 5 by a third nut 10*b*. The second outlet 4*f* extends just below the lid 5 a very short distance into the container 4*a*. The lid 5 and the container 4*a* are constructed and arranged for ready attachment to standard sink and waste lines 8 and 10. Thus, the threads 4*c* and 4*e* are one-and-one-half-inch male plumbing threads, and the inlet 4*b* and the first outlet 4*d* are displaced from one another by the same distance as are the leads from a standard plumbing p-trap; viz., about three-and-one-half inches part. The system 2 as shown here in FIG. 1 is empty; i.e., filled only with air 13. The capacity of the container 4*a* is preferably from about three to about five gallons.

Figure 2:
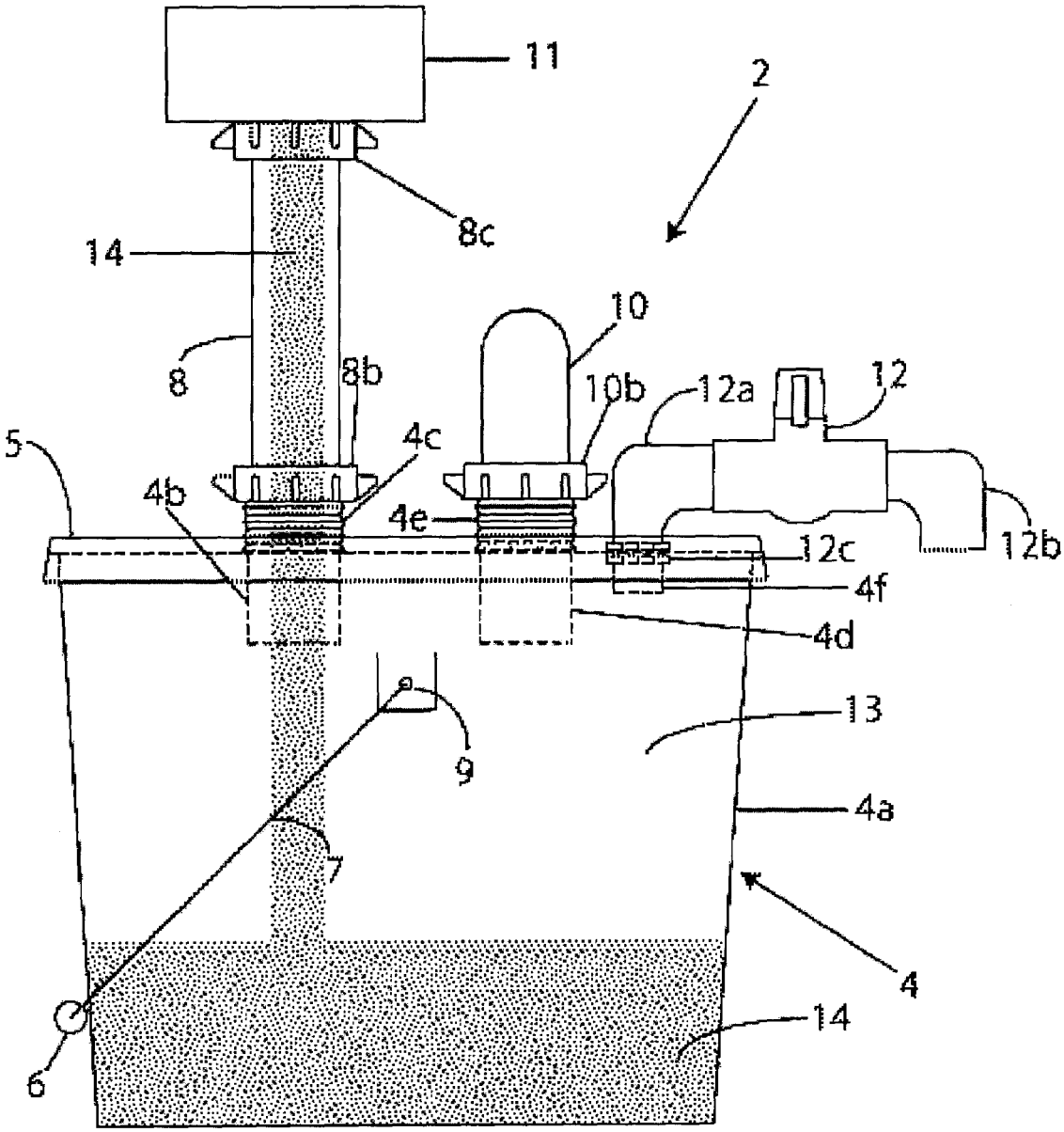
FIG. 2 is a schematic representation of the trap shown in FIG. 1 after water has entered the trap.
Figure 3A:
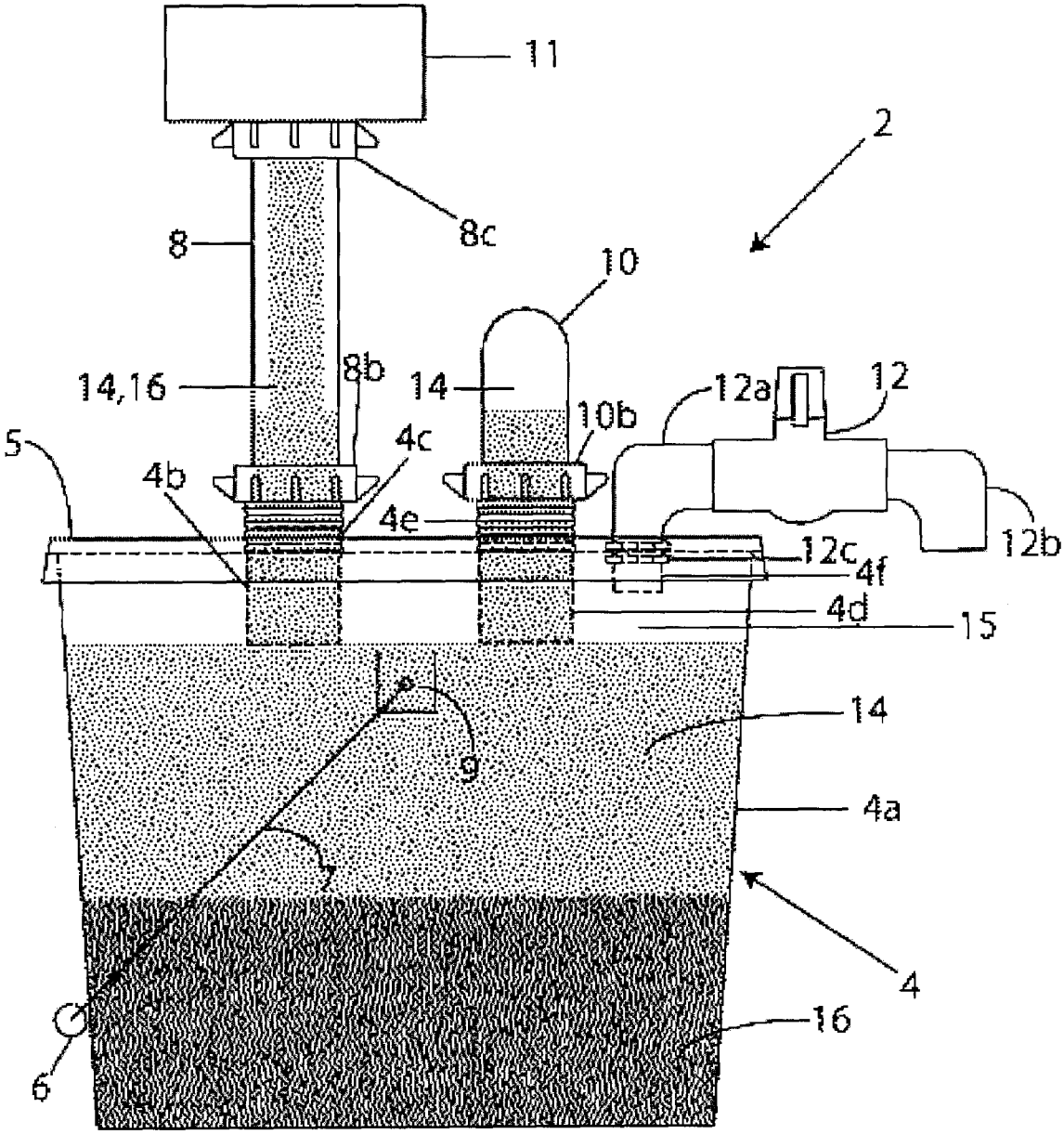
FIG. 3A is a schematic representation of the trap shown in FIG. 1 after water and entrained solids have filled the trap to a first level.

Reference is now made to FIG. 2, in which the container 4*a* is partially filled with water 14 from the sink line 8 via the inlet 4*b*. As water 14 and entrained solids 16 enter the trap 4 through the sink line 8 and the inlet 4*b*, the solids 16 settle to the bottom of the container 4*a*, the water 14 forms a supernatant layer above the solids 16, and water 14 flows out of the trap 4 through the outlet 4*d* and the waste line 10. The situation at this stage is shown in FIG. 3A. A pocket of air 13 is trapped between the surface of the water 14 and the bottom of the lid 5. The second outlet 4*f* extends into this air 13 pocket, but not into the layer of water 14.

Figure 3B:
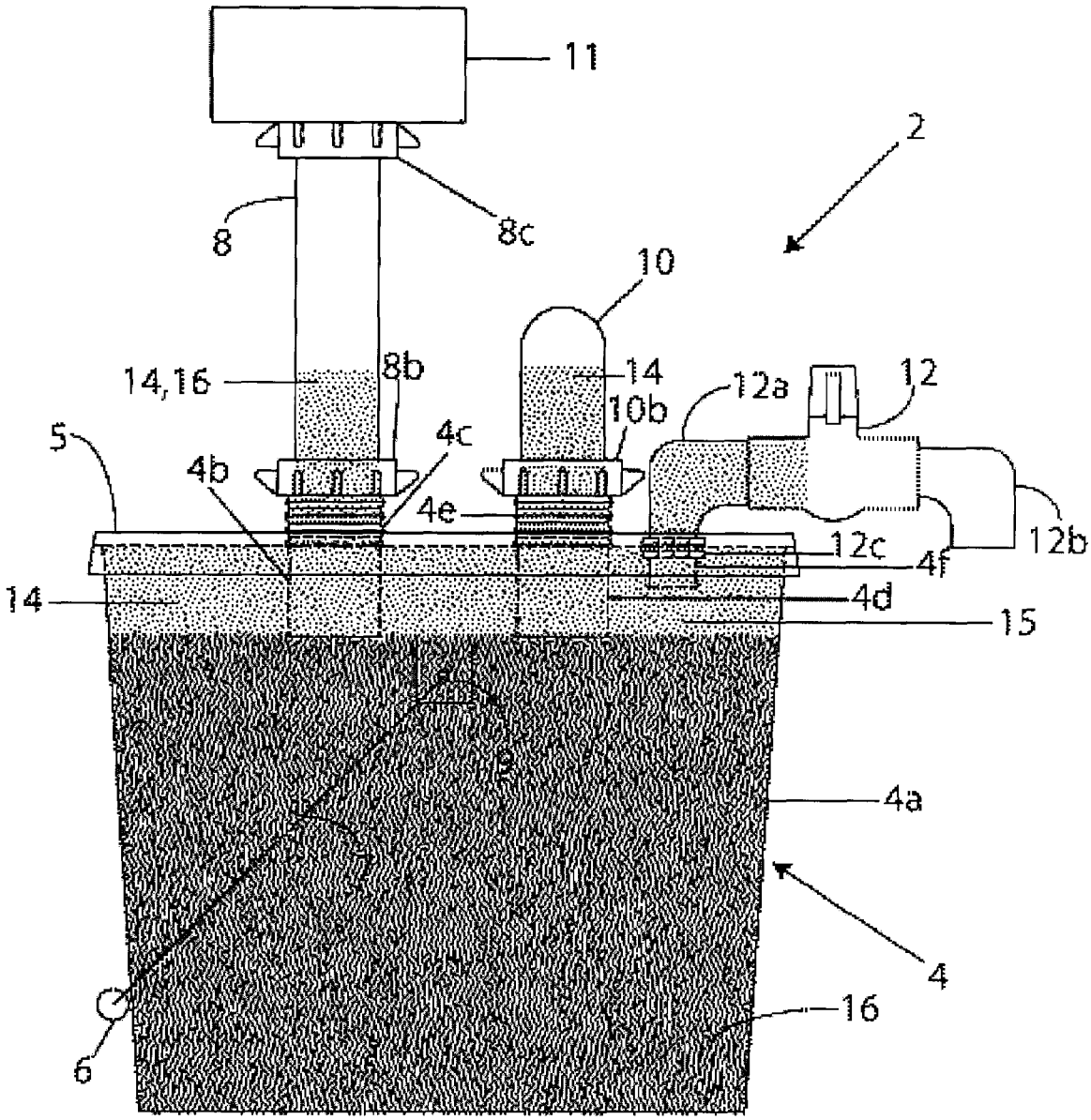
FIG. 3B is a schematic representation of the trap shown in FIG. 1 after water and entrained solids have filled the trap to a second level.
Figure 4A:
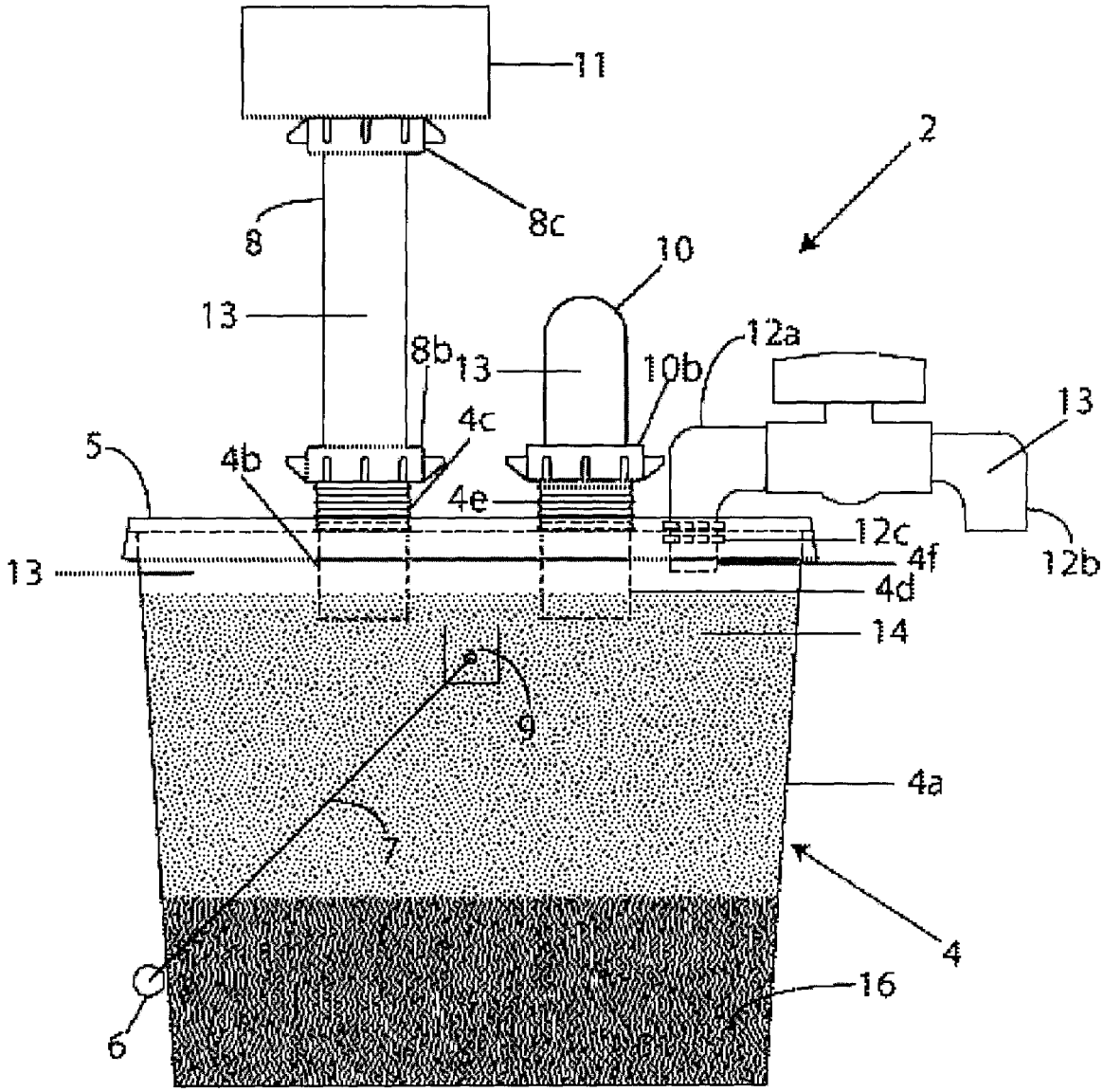
FIG. 4A is a schematic representation of the trap shown in FIG. 3A, showing the drain valve open.
Figure 4B:
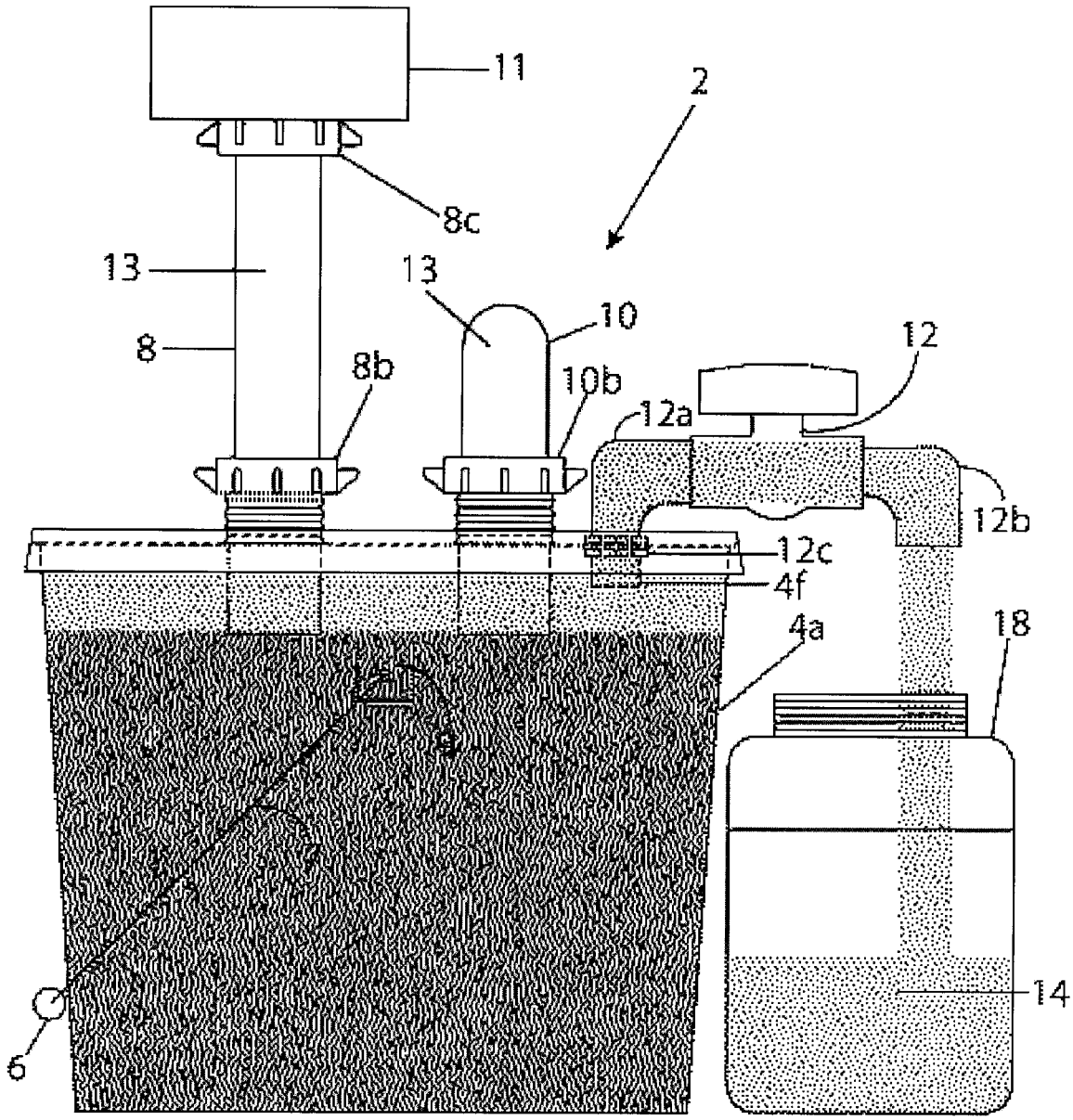
FIG. 4B is a schematic representation of the trap shown in FIG. 3B, showing the drain valve open.
Figure 5:
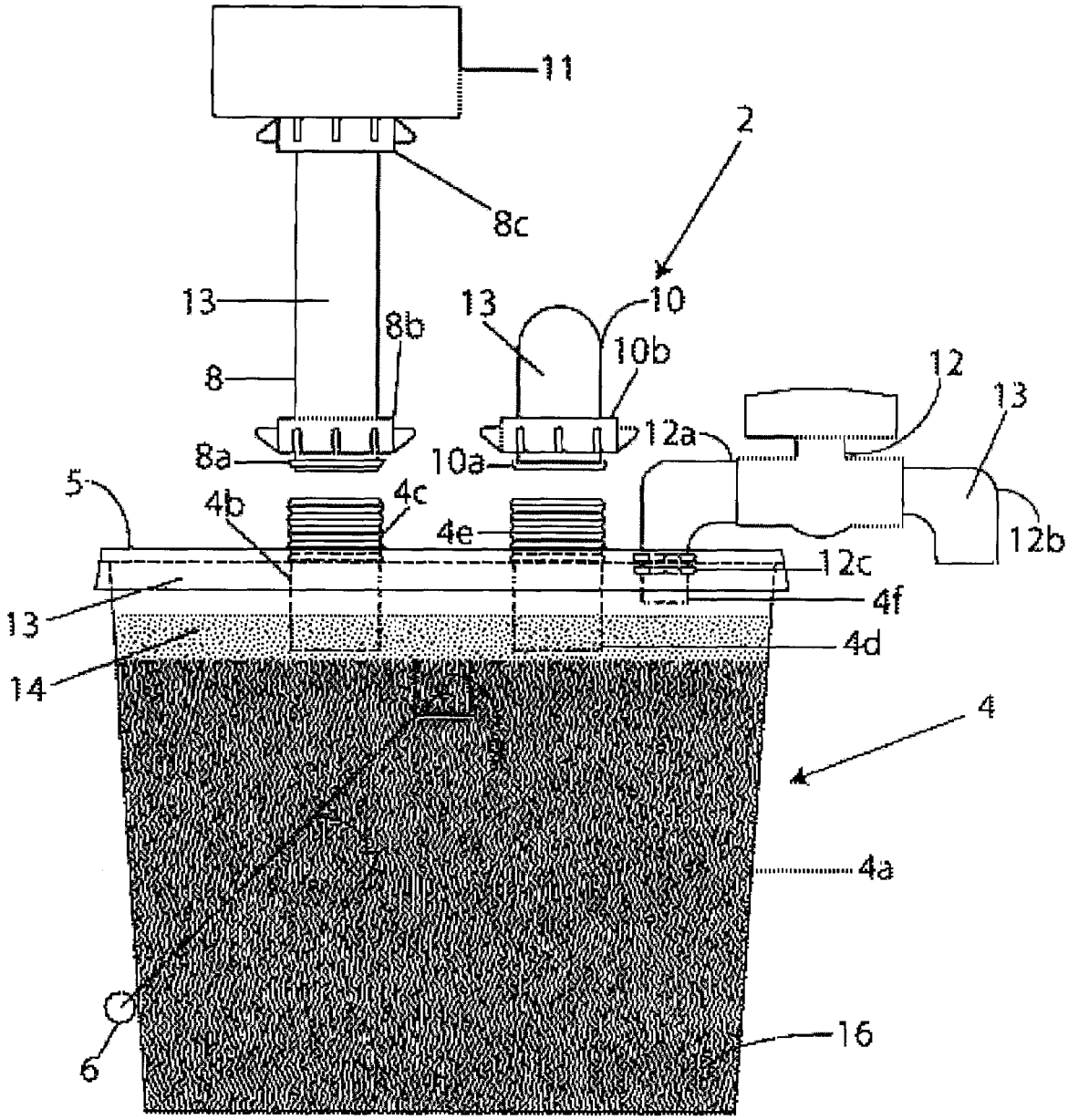
FIG. 5 is a schematic representation of the trap shown in FIGS. 4A and 4B, with the trap disconnected from the sink and waste disposal.

At this point there are two options. The water 14 level is clearly visible through the wall of the container 4*a*. The trapped air 13 can be vented through the drain valve 12, relieving the internal pressure and permitting the water 14 level to rise in the container 4*a* by inflow from the lines 8 and 10. This option is illustrated by FIG. 4A. Alternatively, the water 14 level may be permitted to rise in the container 4*a* until the end of the second outlet 4*f* is below the surface of the water 14. This situation is depicted in FIG. 3B. Then, by opening the valve 12, water 14 is vented via the second outlet 4*f* and the connecting members 12*a* and 12*b* into a receptacle 18 disposed below the end of the second connecting member 12*b*. This option is illustrated in FIG. 4B. For either option, the end result is a relief of internal pressure in the container 4*a* and discharge of residual water 14 from the lines 8 and 10 into the-container 4*a*. The first option is preferable in situations where no convenient receptacle for the vented water is available. The second option is preferable where such a receptacle is conveniently available, because it permits the container 4*a* to be filled with more water before the water is vented. Once air 13 or water 14 has been vented, the disposable solid waste detainment trap 4 is disconnected from the sink and waste lines 8 and 10, by disconnecting the male threads 4*c* and 4*e* from matching female threads 8*a* and 10*a*, as shown in FIG. 5. By replacing the filled trap 4 with an empty trap 4, the disposable solid waste detainment trap 4 is again ready for use, as shown in FIG. 1. This can be done quickly and easily, without spilling of or contact with water or solid waste.

While certain specific embodiments and details have been described to illustrate the present invention, it will be apparent to those skilled in the art that many modifications are possible within the scope of the claimed invention.

We claim:

1. A disposable solid waste detainment plumbing trap, comprising:

(a) a container for collecting water and solid waste discharged from a sink through an inlet of the container, and for discharging water through a first outlet of the container, the inlet being constructed and arranged for direct connection to a first line connected to the sink, and the first outlet being constructed and arranged for direct connection to a second line for waste disposal;

(b) a lid which seals the container, the inlet and the first outlet being disposed in and through the lid, and extending into the container to a distance below the lid; and (c) a valve for venting air or water from the container, to relieve pressure of air trapped therein, the valve being connected to a second outlet which extends into the container to a shorter distance below the lid than the first outlet, whereby level of water can be adjusted so that an end of the second outlet is either above or below surface of the water, and the pressure of the air trapped in the container can be relieved by opening the valve to discharge air or water from the container.

2. The disposable solid waste detainment plumbing trap of claim 1, wherein the container is transparent or translucent, for easy observation of the water level in the container.

3. A method for disposing of solid waste discharged from a plumbing sink, the method comprising the steps of:

(a) providing a container for collecting water and solid waste discharged from the sink through an inlet of the container, and for discharging water through a first outlet of the container, the inlet being constructed and arranged for direct connection to a first line connected to the sink, and the first outlet being constructed and arranged for direct connection to a second line for waste disposal;

(b) providing a lid for sealing the container, the inlet and the first outlet being disposed in and through the lid, and extending into the container to a distance below the lid;

(c) providing a valve for venting air or water from the container, to relieve pressure of air trapped therein, the valve being connected to a second outlet extending into the container to a shorter distance below the lid than the first outlet, whereby level of water can be adjusted so that an end of the second outlet is either above or below surface of the water, and the pressure of the air trapped in the container can be relieved by opening the valve to discharge air or water from the container;

(d) connecting the inlet to the first line, and the first outlet to the second line;

(e) discharging water and solid waste from the sink into the container through the first line and the inlet of the container;

(f) adjusting the level of the water in the container; and (g) opening the valve to discharge air or water from the container.

4. The method of claim 3, wherein the level of the water is adjusted so that the end of the second outlet is above the surface of the water, and the pressure of the trapped air is relieved by opening the valve to discharge air from the container.

5. The method of claim 3, wherein the level of the water is adjusted so that the end of the second outlet is below the surface of the water, and the pressure of the trapped air is relieved by opening the valve to discharge water from the container.

6. The method of claim 3, wherein the container is transparent or translucent, for easy observation of the water level in the container.

* * * * *